US007412953B2

(12) United States Patent
Shimazaki et al.

(10) Patent No.: US 7,412,953 B2
(45) Date of Patent: Aug. 19, 2008

(54) ENGINE CONTROL DEVICE

(75) Inventors: Mitsuyoshi Shimazaki, Numazu (JP); Kazuyoshi Kishibata, Numazu (JP); Hiroyasu Sato, Numazu (JP); Tomohiro Kinoshita, Numazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 194 days.

(21) Appl. No.: 11/502,118

(22) Filed: Aug. 10, 2006

(65) Prior Publication Data

US 2007/0062477 A1 Mar. 22, 2007

(30) Foreign Application Priority Data

Sep. 5, 2005 (JP) ..... 2005-256780

(51) Int. Cl.
*F02D 41/06* (2006.01)
*F02D 29/06* (2006.01)
*F02M 37/04* (2006.01)
*F02N 11/04* (2006.01)

(52) U.S. Cl. ..... 123/179.16; 123/497; 123/489; 123/491; 123/179.9

(58) Field of Classification Search ..... 123/179.3, 123/179.7, 179.9, 179.12, 179.16, 179.17, 123/491, 497, 478
See application file for complete search history.

(56) References Cited

U.S. PATENT DOCUMENTS 3,812,830 A * 5/1974 Traisnel ..... 123/491
5,743,236 A * 4/1998 Kawakami ..... 123/491
6,073,597 A * 6/2000 Harata et al. ..... 123/179.14
6,138,638 A * 10/2000 Morikawa ..... 123/295
6,276,340 B1 * 8/2001 Kato ..... 123/491
6,314,947 B1 * 11/2001 Roche ..... 123/525
6,568,373 B2 * 5/2003 Yuya et al. ..... 123/491
6,708,661 B1 * 3/2004 Aubourg et al. ..... 123/179.16
6,918,367 B2 * 7/2005 Denz et al. ..... 123/179.17
6,955,148 B2 * 10/2005 Rosenzopf et al. ..... 123/179.17
7,066,126 B2 * 6/2006 Tokuyasu et al. ..... 123/179.17
7,093,576 B2 * 8/2006 DeRaad ..... 123/179.17
7,201,127 B2 * 4/2007 Rockwell et al. ..... 123/179.16

FOREIGN PATENT DOCUMENTS

JP 60-90540 6/1985
JP 2005-023911 1/2005

* cited by examiner

*Primary Examiner*—Stephen K. Cronin
*Assistant Examiner*—Arnold Castro
(74) *Attorney, Agent, or Firm*—Pearne & Gordon LLP

(57) ABSTRACT

An engine control device that controls, using a microprocessor, a fuel injection device including an injector and a fuel pump, and a starter motor that starts an engine, including: first fuel pump driving means for driving the fuel pump only during set time at power-on of the microprocessor; and first fuel injection control means for causing the injector to perform first fuel injection before driving of the starter motor when it is confirmed that the driving of the fuel pump by the first fuel pump driving means is completed and that a start command for commanding the start of the engine is given.

4 Claims, 9 Drawing Sheets

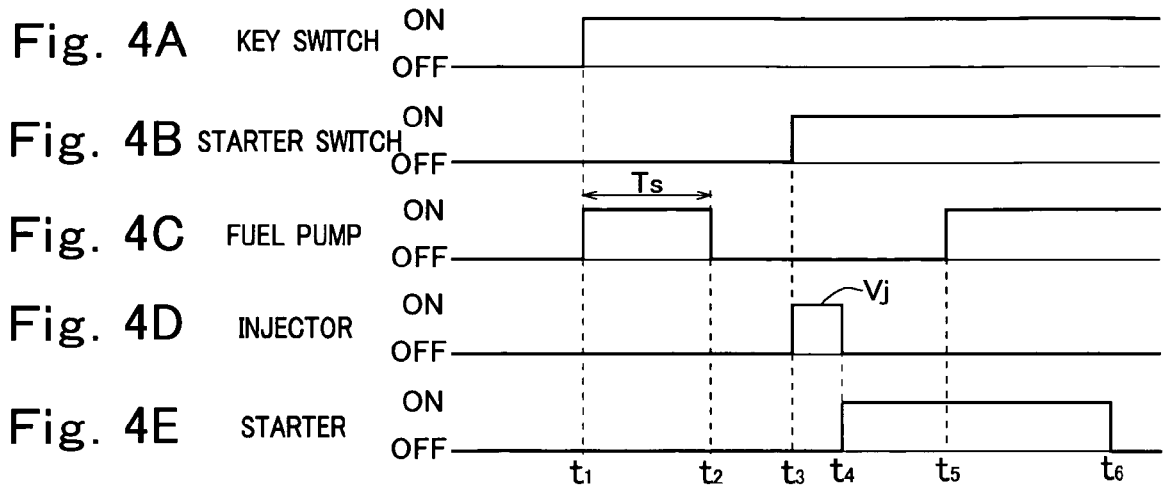
Fig. 9
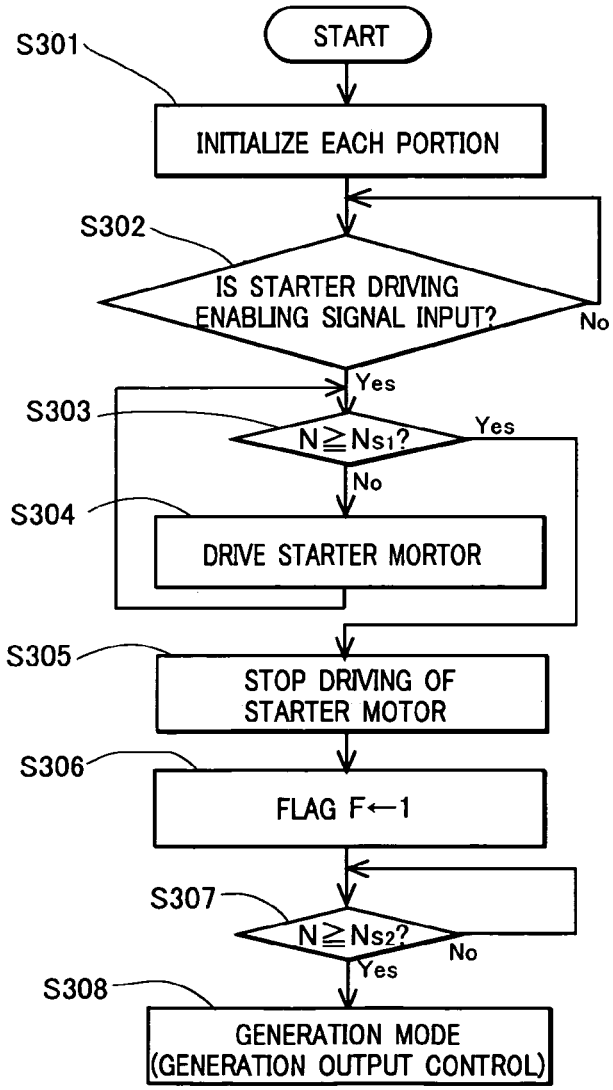

ENGINE CONTROL DEVICE

TECHNICAL FIELD OF THE INVENTION

The present invention relates to an engine control device that controls a fuel injection device and a starter motor or a starter generator using a microprocessor.

BACKGROUND OF THE INVENTION

For an engine to which fuel is supplied by a fuel injection device, fuel needs to be supplied to an injector with sufficient pressure at the start of the engine in order to inject fuel in an amount required at the start of the engine to improve startability of the engine. Thus, as disclosed in Japanese Patent Laid-Open No. 2005-23911, a control device that controls an engine to which fuel is supplied by a fuel injection device includes means for first driving a fuel pump for a predetermined time when the control device is powered on, and the pressure of the fuel supplied to an injector is increased to a predetermined value before the start of cranking of the engine.

When a starting device starts the cranking of the engine, the control device controls fuel injection timing, fuel injection time, and ignition timing based on information obtained from various sensors mounted to the engine.

In the conventional control device, crank angle information of the engine is obtained from an output of a crank angle sensor mounted to the engine, and first fuel injection is performed when the fuel injection timing is detected based on the crank angle information, thereby inevitably causing a delay between the start of the cranking of the engine and the first fuel injection. If the first fuel injection delays, an air/fuel ratio of an air/fuel mixture supplied into a combustion chamber of the engine reaches a predetermined value with a delay, thereby reducing startability of the engine.

Poor startability of the engine increases time for driving a starter motor to increase power consumption of a battery, which requires a high capacity battery and is uneconomical.

When the starter motor is driven, an extremely large amount of electric power is consumed to significantly reduce a terminal voltage of the battery. FIG. 11 shows an example of measurement results of changes in rotational speed and battery voltage at the start of the engine, with driving time of the starter motor on the axis of abscissa. In FIG. 11, the curve a indicates a rotational speed (a cranking speed) of the engine, and the curve b indicates a battery voltage. When the battery voltage decreases, a driving voltage of the injector decreases, and thus a valve of the injector is opened with a delay to prevent a desired amount of fuel from being injected from the injector.

Generally, in a fuel injection device for an engine, the pressure of fuel (fuel pressure) supplied to an injector is controlled to be maintained constant by a pressure regulator, and the amount of fuel injected by the injector depends on time for opening a valve of the injector (valve opening time). The injector does not open the valve immediately after a driving voltage is supplied, but there is delay time (referred to as ineffective injection time) between when the driving voltage is supplied and when the valve is actually opened. Thus, when the fuel injection amount is controlled, valve opening time (time for opening the valve of the injector) required for obtaining the fuel injection amount required for maintaining an air/fuel ratio of an air/fuel mixture within a predetermined range is arithmetically operated relative to various control conditions as effective injection time. Then, the ineffective injection time plus the effective injection time is regarded as apparent fuel injection time, and an injection command signal having a signal width corresponding to the apparent fuel injection time is provided to an injector driving portion. The injector driving portion supplies the driving voltage to the injector while receiving the injection command signal, and injects fuel from the injector during the effective injection time.

FIG. 10 shows the relationship between an injector driving voltage and the ineffective injection time. As shown in FIG. 10, the ineffective injection time is increased with decreasing injector driving voltage. Thus, as shown in FIG. 11, if the battery voltage decreases at the start of the engine to reduce the injector driving voltage, the ineffective injection time of the injector is increased to delay opening of the valve of the injector. The delay of the opening of the valve of the injector causes a shortage in fuel injection amount even if the fuel pressure supplied to the injector is sufficiently increased, thereby inevitably reducing startability of the engine.

Thus, it is considered that the battery voltage is detected, and the ineffective injection time added to the effective injection time is corrected according to the battery voltage, thereby preventing a reduction in the injection amount with decreasing injector driving voltage.

However, at the start of the engine, changes in internal pressure of a cylinder caused by a stroke change of the engine cause a load applied to the starter motor to vary, and as indicated by the curve a in FIG. 11, the rotational speed finely changes according to crank angles, and the variation in the load causes the battery voltage to change. Further, switching of energization performed by a commutation mechanism constituted by a commutator and a brush (for a brushless motor, switching of energization patters) causes a driving current of the starter motor to finely vary, and thus a waveform of the battery voltage significantly changes as shown in FIG. 11.

As described above, the battery voltage significantly changes at the start of the engine, and thus it is difficult to detect the battery voltage to precisely arithmetically operate the ineffective injection time, and difficult to properly correct the ineffective injection time relative to the battery voltage to control the fuel injection amount with high accuracy.

In order to prevent a shortage in fuel injection amount at the start of the engine, a microfilm of Japanese Utility Model Laid-Open No. 60-90540 proposes that an injector is driven to perform first fuel injection when a key switch is closed, and then a starter motor is activated.

If sufficient fuel pressure is supplied to the injector when the key switch is closed, and the starter motor can be activated after the first fuel injection without a delay, the control described in Japanese Utility Model Laid-Open No. 60-90540 can prevent a shortage of fuel at the start of an engine to improve startability of the engine.

However, when the key switch is closed, the fuel pressure supplied to the injector is often insufficient. If the fuel pressure supplied to the injector is insufficient when the key switch is closed, a desired amount of fuel cannot be injected even if first fuel is injected when the key switch is closed, thereby failing in ignition of the fuel at the time of first ignition thereafter, and inevitably reducing startability. The failure in the ignition of the fuel causes unburned gas to be exhausted to pollute the atmosphere.

Further, if time is long between when the key switch is closed and when the starter switch is closed, the fuel injected by the injector adheres to an inner surface of an intake pipe or an inner surface of a cylinder to form a liquid film, which causes a shortage of fuel that contributes to combustion and reduce startability of the engine. Also in this case, the failure in the ignition in the cylinder causes unburned gas to be exhausted to unpreferably pollute the atmosphere.

SUMMARY OF THE INVENTION

An object of the present invention is to provide an engine control device that prevents a shortage in fuel injection amount at the start of an engine to improve startability of the engine, and reduce an exhaust amount of unburned gas to improve an exhaust gas characteristic at the start of the engine.

The present invention is applied to an engine control device that controls, using a microprocessor, a fuel injection device including an injector that injects fuel to be supplied to an engine and a fuel pump that supplies the fuel to the injector, and a starter motor that starts the engine.

The engine control device according to the present invention includes: first fuel pump driving means for driving the fuel pump only during set time required for setting the pressure of the fuel supplied to the injector to a set value or higher at power-on of the microprocessor; and first fuel injection control means for causing the injector to perform first fuel injection before driving of the starter motor when it is confirmed that the driving of the fuel pump by the first fuel pump driving means is completed and that a start command for commanding the start of the engine is given.

As described above, if the first fuel injection is performed after the completion of the first driving of the fuel pump and before the driving of the starter motor, the first fuel injection can be performed with stable fuel pressure supplied to the injector and a stable driving voltage of the injector (before a power supply voltage is reduced by the driving of the starter motor), thereby allowing the fuel to be injected in an amount as arithmetically operated at the time of the first fuel injection. This prevents a shortage in fuel injection amount at the start of the engine to improve startability of the engine. The shortage in the fuel injection amount can be prevented at the start of the engine to prevent failure in ignition at the time of first ignition, thereby reducing an exhaust amount of unburned gas to improve an exhaust gas characteristic at the start of the engine.

In a preferred aspect of the present invention, the engine control device includes: first fuel pump driving means for driving the fuel pump only during set time at power-on of the microprocessor; first fuel injection control means for causing the injector to perform first fuel injection when it is confirmed that the driving of the fuel pump by the first fuel pump driving means is completed and that a start command for commanding the start of the engine is given; and starter motor driving means for driving the starter motor so as to start the engine when it is confirmed that the first fuel injection is completed and that the start command is given.

In another preferred aspect of the present invention, a starter generator that functions as a starter motor at the start of the engine, and functions as a generator for charging a battery after the completion of the start of the engine is mounted to the engine. In this case, the microprocessor receives a power supply voltage from the battery and is operated.

In the case where the starter generator is used as described above, the engine control device includes: first fuel pump driving means for driving the fuel pump only during set time at power-on of the microprocessor; first fuel injection control means for causing the injector to perform first fuel injection when it is confirmed that the driving of the fuel pump by the first fuel pump driving means is completed and that a start command for commanding the start of the engine is given; starter control means for controlling the starter generator so as to cause the starter generator to function as the starter motor to start the engine when it is confirmed that the first fuel injection is completed and that the start command is given; and generation output control means for controlling a generation output of the starter generator so as to prevent a voltage across the battery from exceeding a set value when the start of the engine is confirmed.

The operation of the engine naturally requires normal fuel pump control means for controlling an operation of the fuel pump during an operation of the engine, and normal fuel injection control means for controlling a fuel injection amount from the fuel injection device after the start of the engine. Specifically, the control device according to the present invention requires at least the first fuel pump driving means, the first fuel injection control means, the normal fuel pump control means, and the normal fuel injection control means in connection to the control of the fuel injection amount. For controlling the starter generator, the control device further requires the starter control means and the generation output control means. The control device including an electronically controlled ignition device further requires means for controlling ignition timing. If these controls are performed using one microprocessor, the number of control items is increased to make difficult the control of each item with high accuracy.

Thus, in a preferred aspect of the present invention, two microprocessors are provided, and the first fuel pump driving means, the first fuel injection control means, the normal fuel pump control means, and the normal fuel injection control means are constructed by one of the two microprocessors, and the starter control means and the generation output control means are constructed by the other of the two microprocessors.

The controls are thus shared by the two microprocessors to reduce the number of the control items for each microprocessor, thereby allowing control of the fuel injection amount and control of the generation output to be performed with high accuracy.

BRIEF DESCRIPTION OF THE DRAWINGS

The above and other objects and features of the present invention win be apparent from the detailed description of the preferred embodiment of the invention, which is described and illustrated with reference to the accompanying drawings, in which;

FIGS. 4A to 4E are timing charts showing an operation of a fuel injection device and an operation of a starter motor at the start of the engine in use of the control device according to the first embodiment of the present invention;

FIG. 9 is a flowchart showing an example of an algorithm of a processing executed by a second microprocessor for realizing means in FIG. 7;

DETAILED DESCRIPTION OF THE PREOFERRED EMBODIMENTS

Now, a preferred embodiment of the present invention will be described in detail with reference to the drawings.

Figure 1:
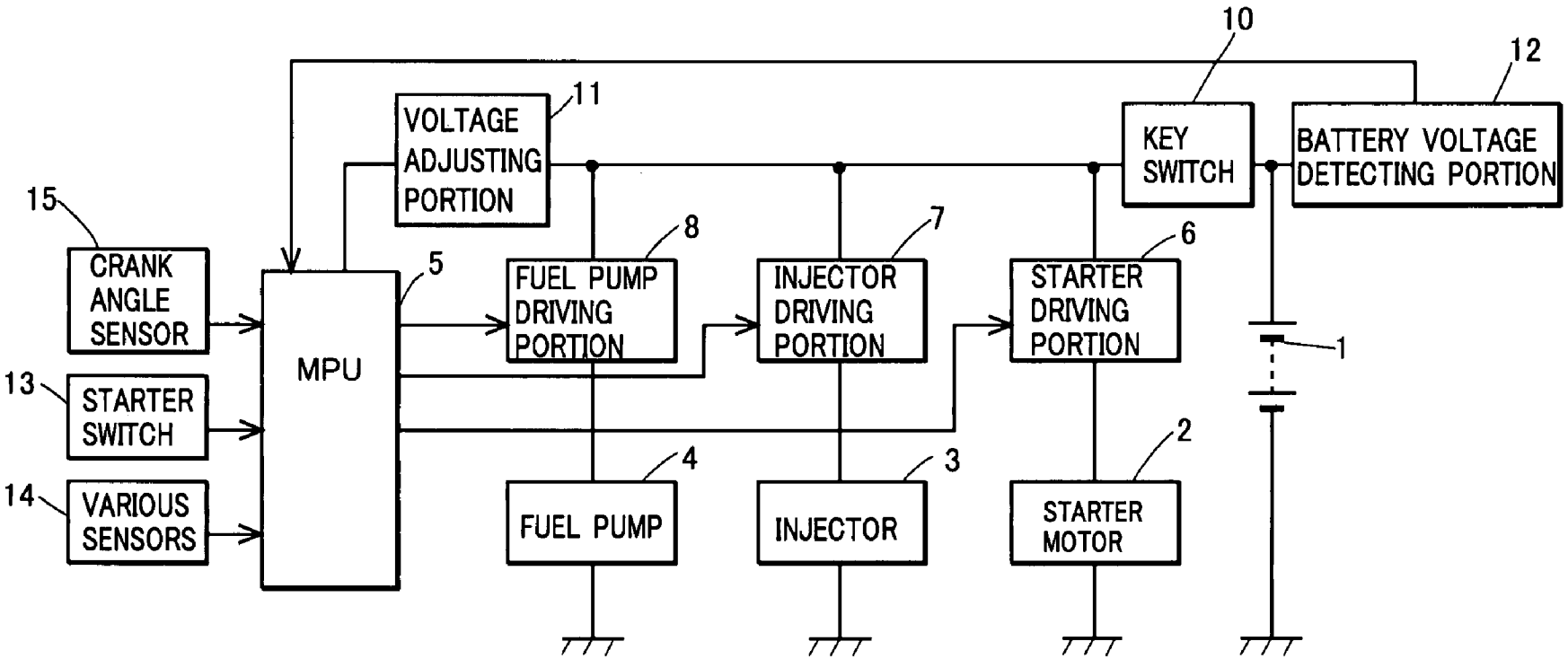
FIG. 1 is a block diagram showing a construction of hardware according to a first embodiment of the present invention.
Figure 2:
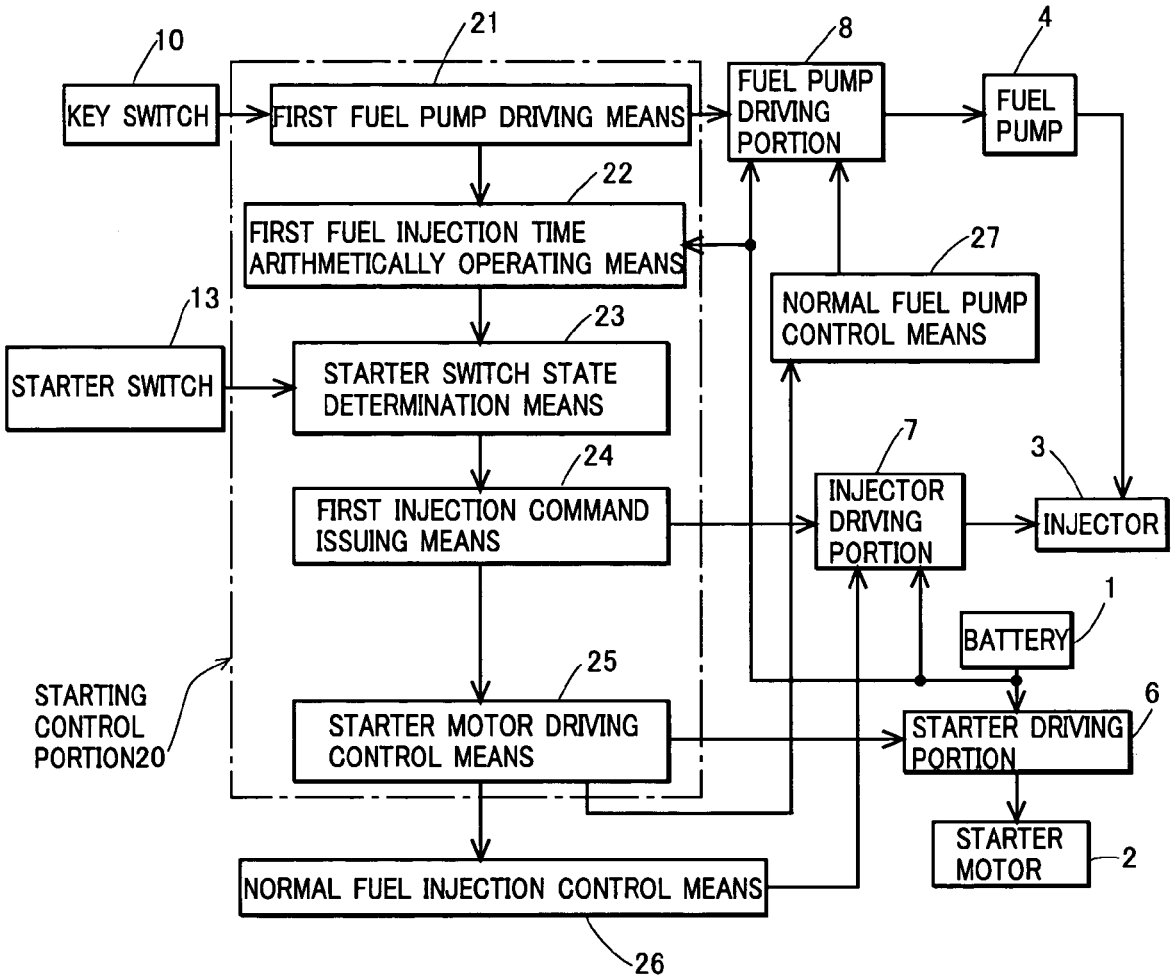
FIG. 2 is a block diagram showing a construction of a control device including means realized by a microprocessor according to the first embodiment of the present invention.
Figure 3:
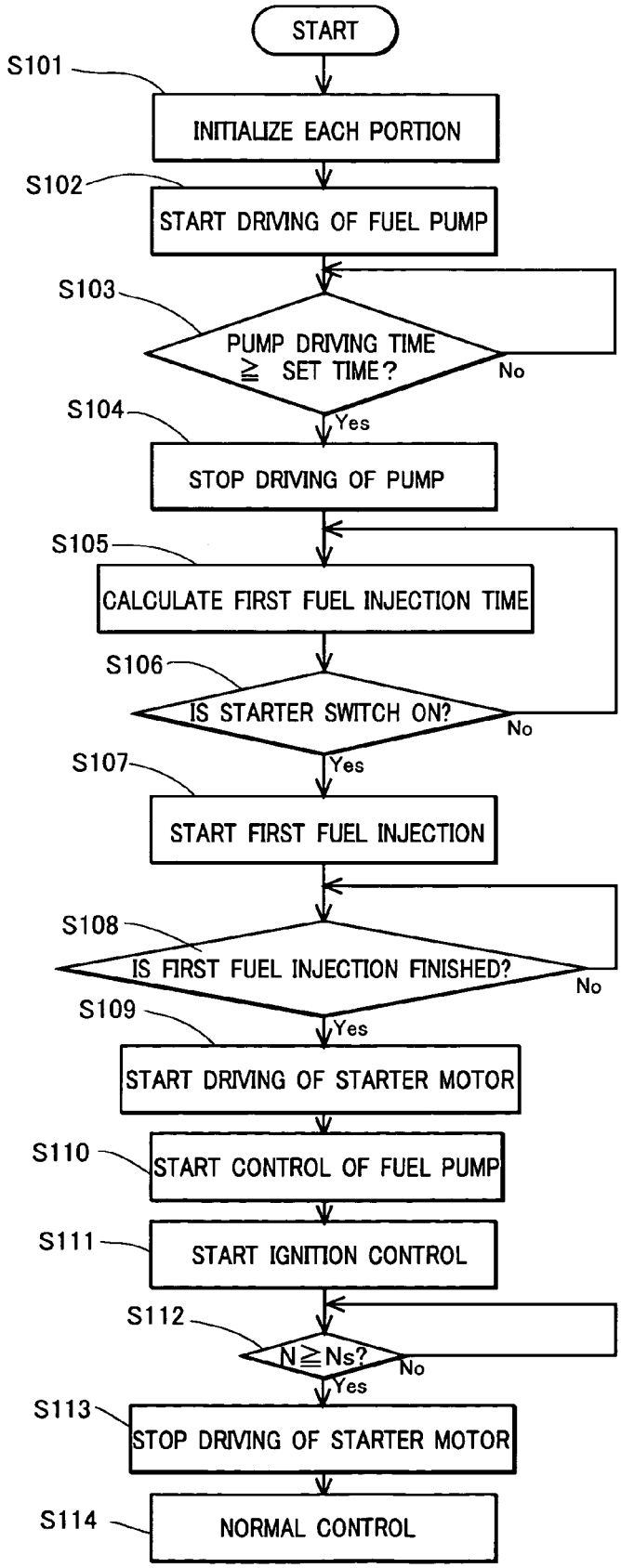
FIG. 3 is a flowchart showing an example of an algorithm of a processing executed by the microprocessor for realizing the means in FIG. 2.

FIGS. 1 to 4 show a first embodiment of the present invention, FIG. 1 shows a construction of hardware, and FIG. 2 shows a construction of a control device including means realized by a microprocessor. FIG. 3 is a flowchart showing an algorithm of a program executed by the microprocessor for constructing the means in FIG. 2, and FIG. 4 is a timing chart showing operations at the start of the engine in the embodiment.

In FIG. 1, a reference numeral 1 denotes a battery; 2, a starter motor that starts an unshown engine; 3, an injector (an electromagnetic fuel injection valve) that injects fuel to be supplied to the unshown engine; 4, a fuel pump that pumps up fuel in an unshown fuel tank and supplies the fuel to the injector 3; and 5, a microprocessor that receives a power supply voltage from the battery 1 and is operated. A starter driving portion 6 is provided for driving the starter motor 2, and an injector driving portion 7 and a fuel pump driving portion 8 are provided for driving the injector 3 and the fuel pump 4, respectively.

A voltage across the battery 1 is supplied to the starter driving portion 6, the injector driving portion 7, and the fuel pump driving portion 8 through a key switch 10, and supplied to the microprocessor 5 through a voltage adjusting portion 11. The starter driving portion 6, the injector driving portion 7, and the fuel pump driving portion 8 include switches having the functions of turning on/of driving currents of the starter motor 2, the injector 3, and the fuel pump 4, respectively, and when the switches are turned on, the driving currents are supplied to the starter motor 2, the injector 3, and the fuel pump 4 from the battery 1 as a power supply. The voltage adjusting portion 11 adjusts the voltage across the battery 1 to a value suitable for driving the microprocessor 5 (for example, 5V), and supplies the voltage to a power terminal of the microprocessor 5.

A reference numeral 12 denotes a battery voltage detecting portion that detects the battery voltage, and information on the battery voltage obtained by the detecting portion is provided to the microprocessor 5. A reference numeral 13 denotes a starter switch that is operated at the start of the engine to issue a start command, 14 denotes various sensors (an intake air temperature sensor, a cooling water temperature sensor, an atmospheric pressure sensor, an intake air pressure sensor, or the like) that detect control conditions for controlling a fuel injection amount, 15 denotes a crank angle sensor that detects crank angle information of the engine. The start command issued by the starter switch 13 and the information detected by the various sensors 14 and the crank angle sensor 15 are provided to the microprocessor 5.

The microprocessor 5 executes a program stored in a ROM to construct various means required for operating the engine. FIG. 2 shows a construction of essential portions of the control device including means relating to the present invention among the various means constructed by the microprocessor 5. In FIG. 2, 20 denotes a starting control portion that performs fuel injection control and control of the starter motor at the start of the engine. The starting control portion is comprised of first fuel pump driving means 21 for driving the fuel pump only during set time at power-on of the microprocessor, first fuel injection time arithmetically operating means 22 for arithmetically operating injection time of first fuel injection after a start operation is started, starter switch state determination means 23 for determining whether the starter switch is closed (whether the start command is given), first injection command issuing means 24 for issuing a first fuel injection command for commanding to cause the first fuel injection to be performed when it is confirmed that the driving of the fuel pump by the first fuel pump driving means 21 is completed and that the start command is given by the starter switch state determination means 23, and starter motor driving control means 25 for driving the starter motor 2 so as to start the engine when it is confirmed that the first fuel injection is completed and that the start command is given.

In this embodiment, first fuel injection control means is comprised of the first fuel injection time arithmetically operating means 22, the starter switch state determination means 23, and the first injection command issuing means 24. The first fuel injection control means causes the injector 3 to perform the first fuel injection when it is confirmed that the driving of the fuel pump by the first fuel pump driving means 21 is completed and that the start command is given from the starter switch.

In the example in FIG. 2, there are provided, besides the starting control portion 20, normal fuel injection control means 26 for performing fuel injection control after the start of the engine, and normal fuel pump control means 27 for restarting the driving of the fuel pump after the start operation of the engine is started to control an operation of the fuel pump during an operation of the engine.

Means for controlling an ignition device that ignites the engine is naturally required for maintaining the operation of the engine, and in some cases, exhaust gas timing of the engine is controlled, but descriptions on means for such controls will be omitted.

FIG. 3 is a flowchart showing an example of an algorithm of a program executed by the microprocessor for constructing the starting control portion 20 in FIG. 2. The processing in FIG. 3 is started when the key switch 10 is turned on and the microprocessor 5 is powered on. When the processing is started, each portion is first initialized in Step S101, and the driving of the fuel pump 4 is started in Step S102. Then, it is determined in Step S103 whether driving time of the fuel pump is set time or longer. When it is determined that the driving time of the pump is the set time or longer, the process moves to Step S104 to stop the driving of the fuel pump.

After the driving of the fuel pump 4 is stopped in Step S104, first fuel injection time is arithmetically operated in Step S105, and it is determined in Step S106 whether the starter switch 13 is on. When it is determined that the starter switch is not on, turning-on of the starter switch is waited, and the first fuel injection time is again arithmetically operated.

The first fuel injection time is effective injection time plus ineffective injection time, the effective injection time being arithmetically operated relative to the control conditions such as an intake air temperature, a cooling water temperature of the engine, and/or atmospheric pressure. The ineffective injection time varies depending on battery voltages, and is corrected according to a battery voltage detected by the battery voltage detecting portion 12.

When it is determined in Step S106 that the starter switch is on, the process moves to Step S107 to issue a first fuel injection command and start first fuel injection, and it is determined in Step S108 whether the first fuel injection is finished (whether the first fuel injection time has passed). When it is determined that the first fuel injection is completed, the process moves to Step S109 to start the driving of the starter motor, then Step S110 of starting the control of the fuel pump for normal operation when fixed time has passed and Step S111 of starting the ignition control of the engine are executed, and it is determined in Step S112 whether a rotational speed N of the engine is a start completion determination speed Ns or higher. The rotational speed N is arithmetically operated from a generation cycle of crank angle detecting pulses output by the crank angle sensor 15. When it is determined in Step S112 that the rotational speed N is the start completion determination speed Ns or higher (when it is determined that the start of the engine is completed), energization of the starter motor 2 is stopped in Step S113, and the control is shifted to normal control in Step S114.

In the normal control, basic fuel injection time is arithmetically operated relative to an intake air amount. The intake air amount is detected by an air flow meter, estimated from the rotational speed of the engine and an internal pressure of an intake pipe, or estimated from a throttle valve opening and the rotational speed of the engine. The effective injection time is arithmetically operated by multiplying the basic fuel injection time by correction coefficient arithmetically operated relative to the control conditions such as the intake air temperature, the cooling water temperature of the engine, the atmospheric pressure, and/or the rotational speed of the engine, and the ineffective injection time is added to the effective injection time to arithmetically operate an apparent fuel injection time. Then, when fuel injection timing is detected from an output of the crank angle sensor or the like, an injection command pulse having a signal width corresponding to the apparent fuel injection time is generated, and the injection command pulse is provided to the injector driving portion 7. The injector driving portion 7 supplies the driving current to the injector 3 while receiving the injection command pulse, and causes the injector 3 to inject fuel during the arithmetically operated effective injection time.

In the embodiment, the first fuel pump driving means 21 is constituted in Steps S102 to S104, and the first fuel injection time arithmetically operating means 22 is constructed in Step S105. The starter switch state determination means 23 is constructed in Step S106, and the first injection command issuing means is constructed in Step S107. Further, the starter control means 25 is constructed in Steps S108 to S112, and the normal fuel pump control means 27 is constructed in Step S110. The normal fuel injection control means is constructed in Step S114.

FIGS. 4A to 4E are timing charts showing the operations at the start of the engine when the engine is controlled by the control device according to the embodiment. When the key switch 10 is closed at time t1, the fuel pump 4 is driven until time t2 (during set time Ts), then an injection command pulse Vj is provided to the injector driving portion 7 at time t3. The first fuel injection is performed during the generation of the injection command pulse. When the first fuel injection is finished at time t4, the driving of the starter motor is started, and formal driving of the fuel pump is started at time t5. Then, when it is determined at time t6 that the rotational speed of the engine reaches the start completion determination speed or higher, the starter motor is stopped.

Figure 5:
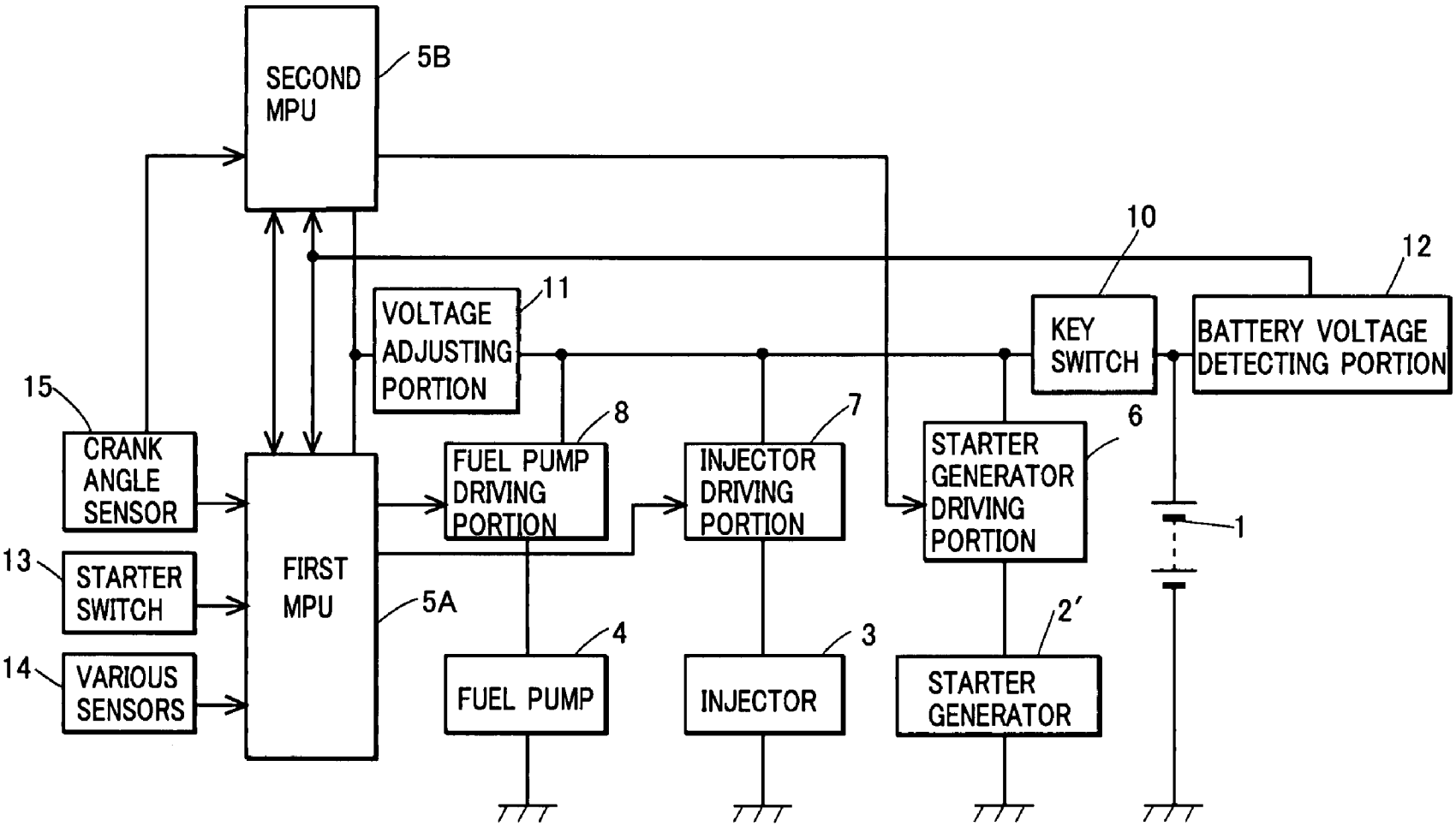
FIG. 5 is a block diagram showing a construction of hardware according to a second embodiment of the present invention.
Figure 7:
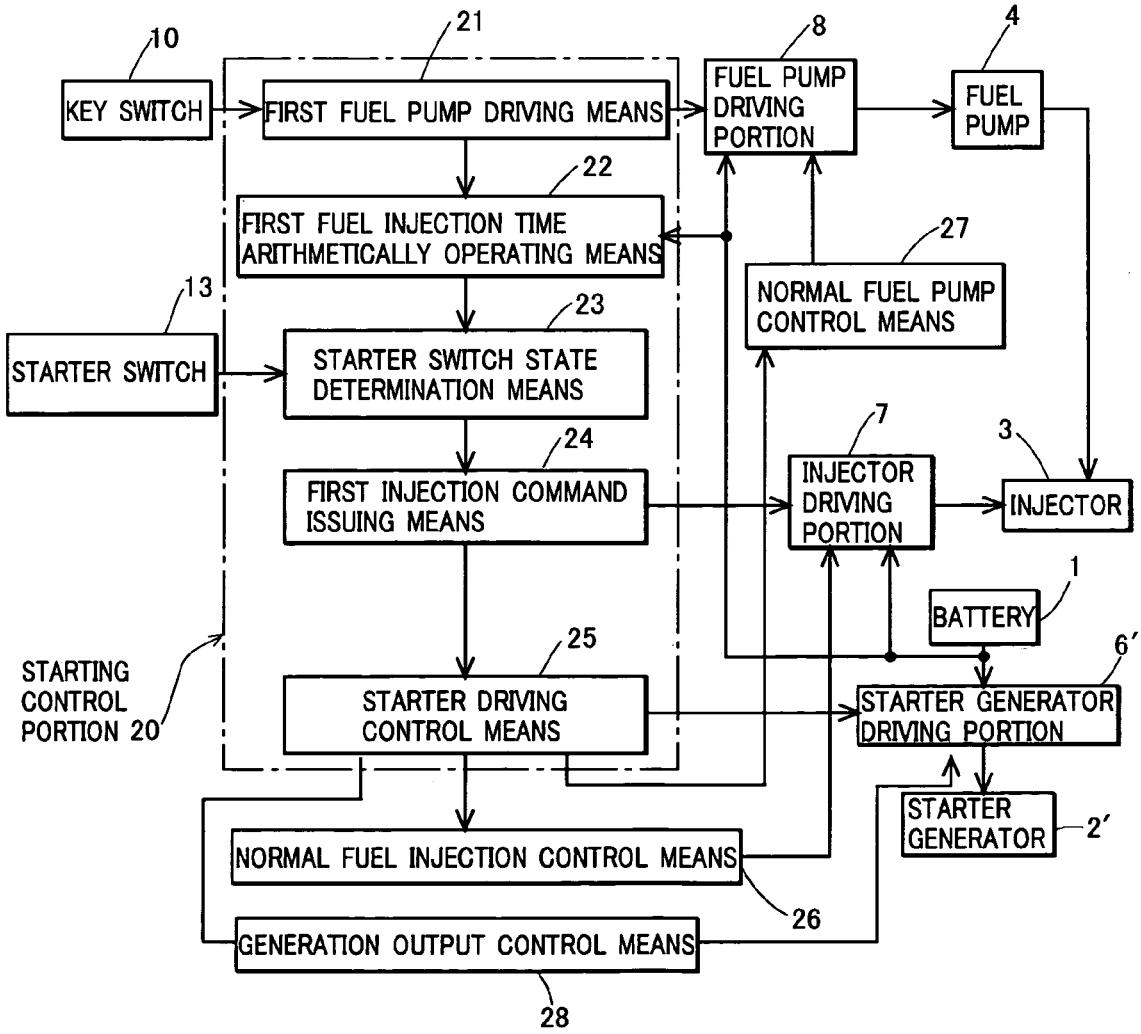
FIG. 7 is a block diagram showing a construction of a control device including means realized by a microprocessor according to the second embodiment of the present invention.
Figure 8:
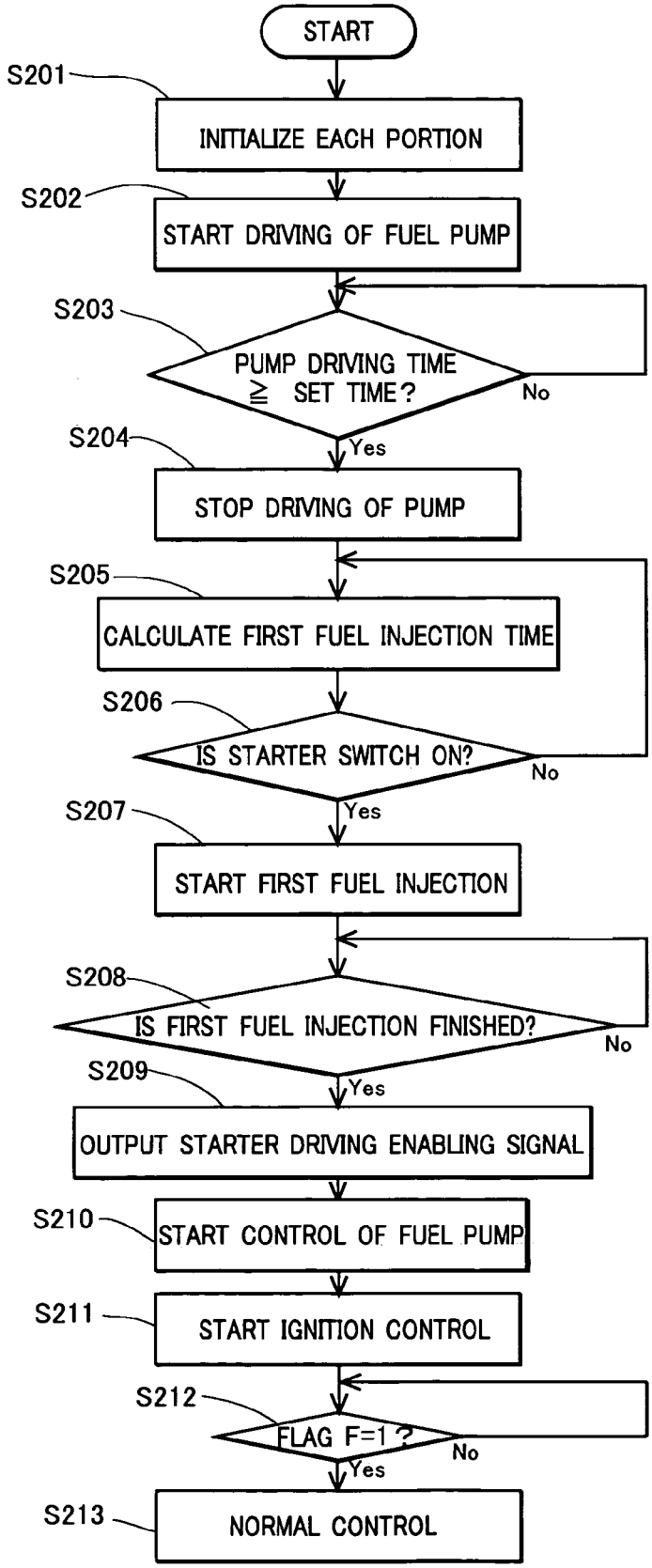
FIG. 8 is a flowchart showing an example of an algorithm of a processing executed by a first microprocessor for realizing the means in FIG. 7.
Figure 10:
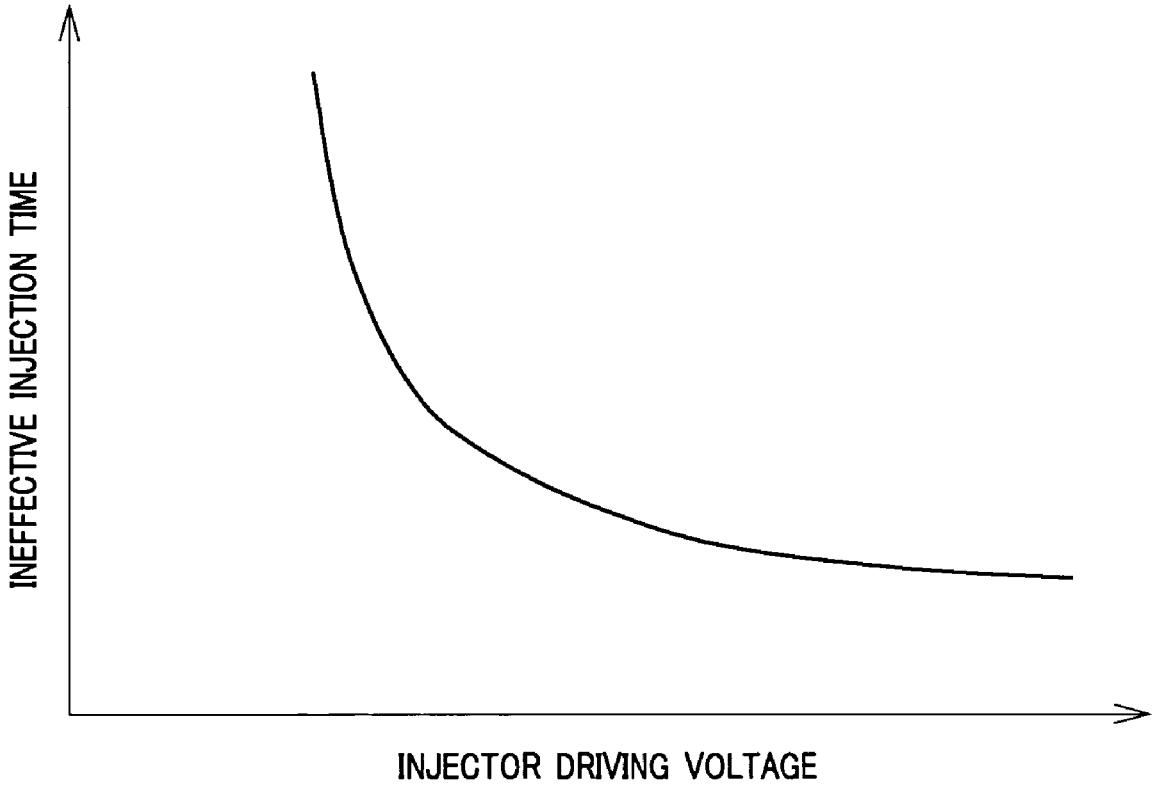
FIG. 10 is a graph showing the relationship between ineffective injection time and a driving voltage of an injector.
Figure 11:
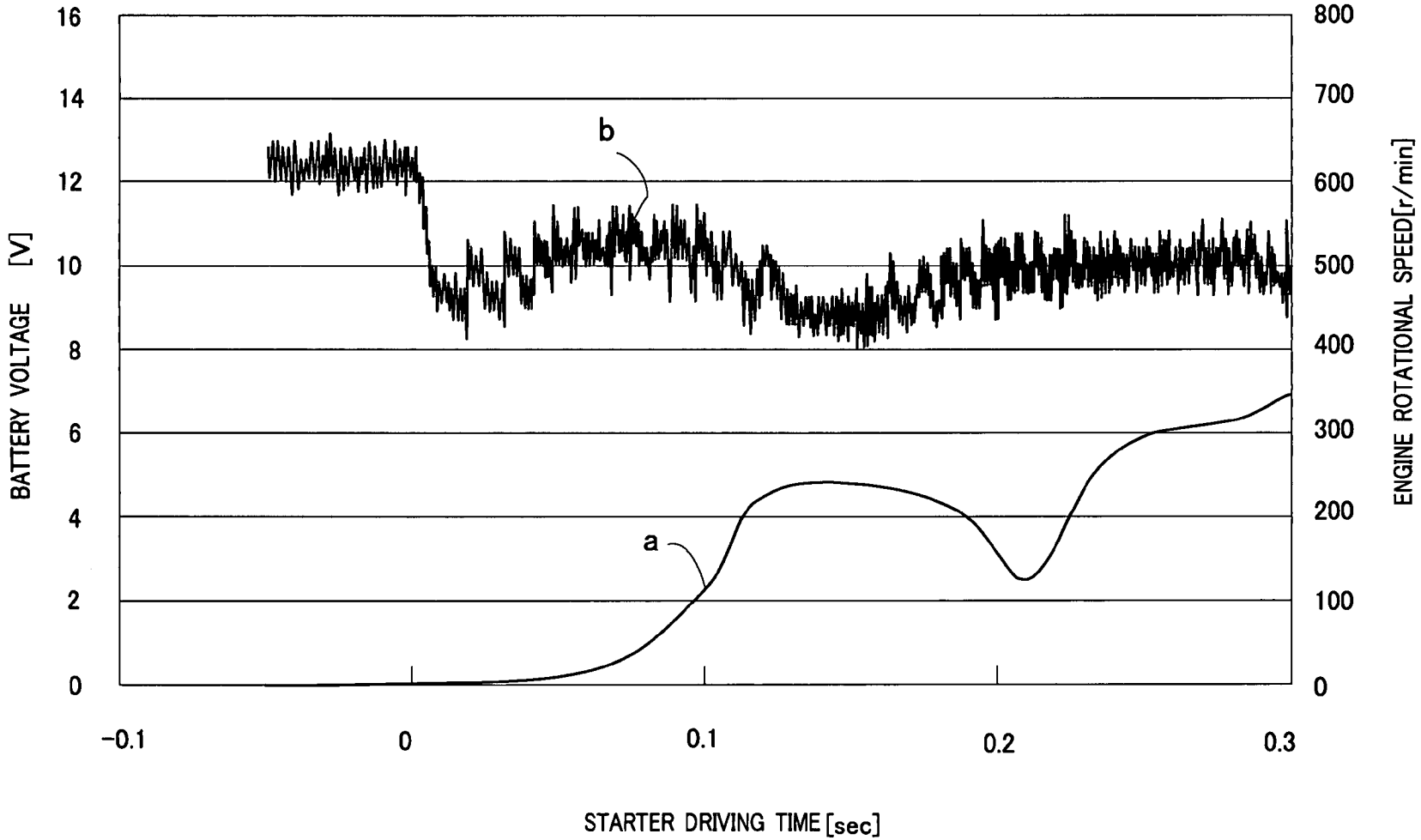
FIG. 11 is a graph showing measurement results of the relationship between a battery voltage for driving a starter motor that starts the engine and driving time of the starter motor, and the relationship between a rotational speed of the engine and the driving time of the starter motor.

Then, a second embodiment of the present invention will be described with reference to FIGS. 5 to 9. FIG. 5 is a block diagram showing a construction of hardware according to the second embodiment, FIG. 6 is a schematic circuit diagram showing an exemplary construction of a starter generator driving portion in FIG. 5, FIG. 7 is a block diagram showing a construction of a control device including portions constructed by a microprocessor, and FIGS. 8 and 9 are flowcharts showing algorithms of programs executed by the microprocessor for constructing means in FIG. 7.

In FIG. 5, the same components as in FIG. 1 are denoted by the same reference numerals. In the embodiment, a starter generator 2' is mounted to an engine instead of the starter motor in FIG. 1. The starter generator 2' is a rotating electric machine that functions as a starter motor at the start of the engine, and functions as a generator for charging a battery after the completion of the start of the engine. The rotating electric machine is comprised of, for example, a magnet rotor constructed by mounting a permanent magnet to a rotor yoke, and a stator having an armature coil wound around an armature core having magnetic pole portions facing magnetic poles of the magnet rotor, driven as a brushless motor at the start of the engine, and driven by the engine to function as a magnetic AC generator after the start of the engine.

Figure 6:
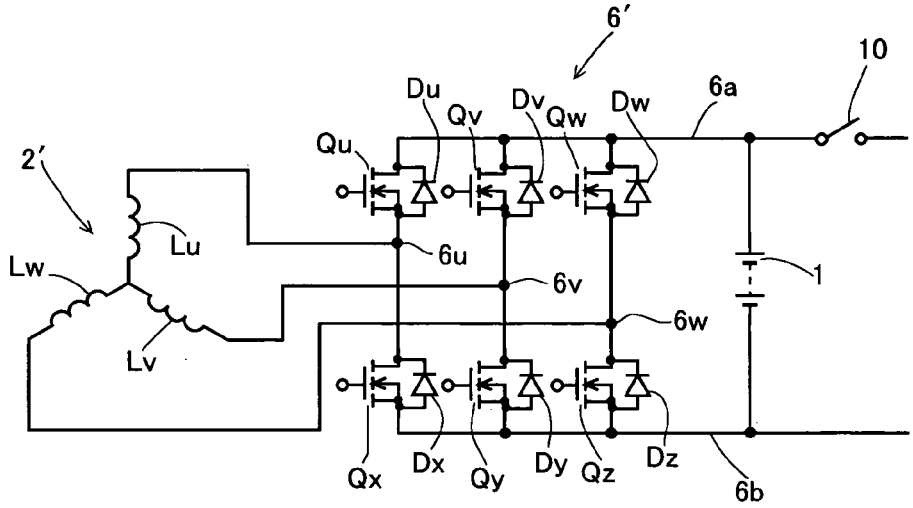
FIG. 6 is a schematic circuit diagram showing an exemplary construction of a starter generator driving portion in FIG. 5.

FIG. 6 shows an exemplary construction of a starter generator driving portion 6' when a starter generator is used that is comprised of a magnet rotor having 2n poles (n is an integer equal to or more than 1) and a stator having 3n poles, operates as a three-phase brushless motor at the start of the engine, and operates as a three-phase magnetic AC generator after the start of the engine.

The starter generator driving portion 6' in FIG. 6 comprises a three-phase inverter circuit. The three-phase inverter circuit comprises a three-phase bridge switch circuit in which switches Qu to Qw having one ends commonly connected form upper sides of a bridge, and switches Qx to Qz having one ends connected to the other ends of the switches Qu to Qw and the other end commonly connected form lower sides of the bridge, and a three-phase full-wave rectifier circuit constituted by diodes Du to Dw connected in anti-parallel to the switches Qu to Qw and diodes Dx to Dz connected in anti-parallel to the switches Qx to Qz. The switches Qu to Qw and Qx to Qz are comprised of switch elements that can be freely turned on/off. In the example in FIG. 6, MOSFETs are used as the switch elements that constitute the switches.

In FIG. 6, Lu to Lw denote three-phase armature coils star-connected, and terminals of the armature coil opposite to a neutral point are connected to three-phase AC terminals 6*u* to 6*w* of the inverter circuit. The battery 1 is connected between DC terminals 6*a* and 6*b* of the inverter circuit.

When the starter generator driving portion in FIG. 6 is used, a position sensor that detects a rotational angle position of the magnet rotor is provided, and rotational angle position information of the rotor detected by the position sensor is provided to the microprocessor. Then, at the start of the engine, with consideration for prevention of a short-circuit across the battery 1, one switch selected from the switches Qu to Qw on the upper side of the bridge of the inverter circuit and one switch selected from the switches Qx to Qz on the lower side of the bridge are turned on to pass a driving current from the battery 1 through the armature coils Lu to Lw so as to pass the driving current through the armature coils Lu to Lw in an energization pattern required for rotating the magnet rotor in the direction of starting the engine.

After the start of the engine, a three-phase AC voltage induced in the armature coil Lu to Lw is rectified through the three-phase full-wave rectifier circuit constituted by the diodes Du to Dw and Dx to Dz and supplied to the battery 1. The induced voltage in the armature coil increases with increasing rotational speed of the engine, and thus the microprocessor controls the inverter circuit so as to maintain a voltage applied across the battery at a set value or lower and controls a generation output.

The generation output can be controlled by on/off control of the switches that constitute the inverter circuit so as to short-circuit the generation output when the voltage across the battery exceeds the set value, and remove the short circuit when the voltage across the battery becomes lower than the set value. Specifically, the microprocessor simultaneously provides drive signals to the switches Qx to Qz on the lower side of the bridge of the inverter circuit when the battery voltage detected by a battery voltage detecting portion 12 exceeds the set value, or simultaneously provides drive signals to the switches Qu to Qw on the upper side of the bridge, to simultaneously turn on the switches Qx to Qz on the lower side of the bridge or the switches Qu to Qw on the upper side of the bridge, and short-circuit a three-phase output of the starter generator through any of these switches and any of the diodes that constitute the rectifier circuit, thereby reducing the generation output of the starter generator. For example, the microprocessor simultaneously turn on the switches Qx to Qz on the lower side of the bridge to short-circuit the three-phase output of the starter generator through any of these switches and any of the diodes Dx to Dz, thereby reducing the generation output. When the voltage applied to the battery becomes lower than the set value, the provision of the drive signals to the switches Qx to Qz or the switches Qu to Qw is stopped to remove the short circuit of the three-phase output of the starter generator, and restore the generation output. These operations maintain the voltage applied to the battery 1 within a set range.

In the embodiment, two microprocessors: a first microprocessor 5A and a second microprocessor 5B are provided, the first microprocessor 5A controls a fuel pump and an injector, and the second microprocessor 5B controls the starter generator 2'. The first microprocessor 5A and the second microprocessor 5B receive a power supply voltage from the battery 1 through a key switch 10 and a voltage adjusting portion 11.

An output of the battery voltage detecting portion 12 is provided to both the first microprocessor and the second microprocessor, and an output of a crank angle sensor 15 is provided to both the first microprocessor and the second microprocessor. The first microprocessor 5A and the second microprocessor 5B are connected by a communication line for data exchange, and data stored in one of the first microprocessor and the second microprocessor can be read in the other, or a signal generated by one of the first microprocessor and the second microprocessor can be received by the other. For example, data on a rotational speed of the engine arithmetically operated by the first microprocessor 5A can be read in the second microprocessor 5B.

In the embodiment, a construction of a control device including means realized by the microprocessors is as shown in FIG. 7. The construction of the control device in FIG. 7 is the same as the construction of the control device in FIG. 2 except that the starter generator 2' is used instead of the starter motor 2, the starter generator driving portion 6' is provided instead of the starter driving portion 6, and generation output control means 28 is further provided that controls a generation output of the starter generator so as to prevent the voltage across the battery 1 from exceeding the set value when the start of the engine is confirmed.

FIG. 8 is a flowchart showing an algorithm of a processing executed by the first microprocessor 5A for realizing each means of the control device in FIG. 7, and FIG. 9 is a flowchart showing an algorithm of a processing executed by the second microprocessor 5B.

A processing in FIG. 8 and a processing in FIG. 9 are started when the key switch 10 is turned on and the first microprocessor 5A and the second microprocessor 5B are powered on.

The first microprocessor 5A first initializes each portion in Step S201 in FIG. 8, and starts driving of a fuel pump 4 in Step S202. Then, it is determined in Step S203 whether driving time of the fuel pump is set time or longer. When it is determined that the driving time of the pump is the set time or longer, the process moves to Step S204 to stop the driving of the fuel pump.

After the driving of the fuel pump 4 is stopped in Step S204, first fuel injection time is arithmetically operated in Step S205, and it is determined in Step S206 whether a starter switch 13 is on. When it is determined that the starter switch is not on, turning-on of the starter switch is waited, and the first fuel injection time is again arithmetically operated.

When it is determined in Step S206 that the starter switch is on, the process moves to Step S207 to issue a first fuel injection command and start first fuel injection, and it is determined in Step S208 whether the first fuel injection is finished (whether the first fuel injection time has passed). When it is determined that the first fuel injection is completed, the process moves to Step S209 to output a starter driving enabling signal to the second microprocessor 5B, then Step S210 of starting the control of the fuel pump for normal operation when fixed time has passed and Step S211 of starting ignition control of the engine are executed. Then, it is determined in Step S212 whether a flag F is set that is set to 1 when the start of the engine is completed. When it is determined that the flag F is set to 1, the control is shifted to normal control.

On the other hand, the second microprocessor 5B initializes each portion in Step S301 when powered on, then waits for the first microprocessor 5A to generate the starter driving enabling signal in Step S302. When the starter driving enabling signal is generated, it is determined in Step S303 whether a rotational speed N of the engine is a start completion determination rotational speed Ns1 or higher. When the rotational speed N is not the start completion determination rotational speed Ns1 or higher, in Step S304, the starter generator driving portion 6' is controlled so as to operate the starter generator 2' as a brushless motor, and the starter generator 2' is operated as a starter motor. Steps S303 and S304 are repeated until the rotational speed N of the engine reaches the start completion determination rotational speed Ns1 to continue driving the starter generator as the motor, and the process moves to Step S305 when the rotational speed N of the engine reaches the start completion determination rotational speed Ns1 or higher to stop the driving of the starter generator as the starter motor. Then, a flag F that indicates the completion of the start of the engine is set to 1 in Step S306, and the rotational speed N of the engine reaching a set rotational speed Ns2 set higher than the start completion determination rotational speed Ns1 is waited in Step S307. The set rotational speed Ns2 is a speed for determining whether the rotational speed of the engine reaches a rotational speed that causes no trouble if the starter generator 2' is operated as the generator and a load is put on the engine. When it is determined in Step S307 that the rotational speed N of the engine reaches the set rotational speed Ns2 or higher, the process moves to Step S308 to set a control mode to a generation mode. In the generation mode, the generation output of the starter generator 2' is controlled so as to prevent the voltage across the battery 1 from exceeding the set value.

In the embodiment, first fuel pump driving means 21 is constituted in Steps S202 to S204 in FIG. 8, and the first fuel injection time arithmetically operating means 22 is constituted in Step S205. Starter switch state determination means 23 is constituted in Step S206, and first injection command issuing means is constituted in Step S207. Further, starter driving enabling signal generating means is constituted in Steps S208 and S209, and normal fuel pump control means 27 is constituted in Step S210. Normal fuel injection control means is constituted in Step S213.

Further, starter control means 25 is constituted in Steps S302 to S305 in FIG. 9, and generation output control means 28 is constructed in Step S308.

As shown in FIG. 5, when the two microprocessors 5A and 5B are provided, ignition timing of the engine may be controlled by either the microprocessor 5A or the microprocessor 5B.

As described above, according to the present invention, after the completion of the driving of the first fuel pump, the first fuel injection is performed before the power supply voltage is reduced by the driving of the starter motor. Thus, the fuel in an amount as arithmetically operated at the time of the first fuel injection can be injected to prevent a shortage in the fuel injection amount at the start of the engine, thereby improving startability of the engine.

According to the present invention, the shortage of the fuel injection amount at the start of the engine is prevented to prevent failure in ignition at the time of first ignition, thereby reducing an exhaust amount of unburned gas to improve an exhaust gas characteristic at the start of the engine.

Although the preferred embodiment of the invention has been described and illustrated with reference to the accompanying drawings, it will be understood by those skilled in the art that it is by way of examples, and that various changes and modifications may be made without departing from the spirit and scope of the invention, which is defined only to the appended claims.

What is claimed is:

1. An engine control device that controls a fuel injection device including an injector that injects fuel to be supplied to an engine and a fuel pump that supplies the fuel to said injector, and a starter motor that starts said engine, using a microprocessor, comprising:

first fuel pump driving means for driving said fuel pump only during set time at power-on of said microprocessor; and first fuel injection control means for causing said injector to perform first fuel injection before driving of said starter motor when it is confirmed that the driving of the fuel pump by said first fuel pump driving means is completed and that a start command for commanding the start of said engine is given.

2. An engine control device that controls a fuel injection device including an injector that injects fuel to be supplied to an engine and a fuel pump that supplies the fuel to said injector, and a starter motor that starts said engine, using a microprocessor, comprising:

first fuel pump driving means for driving said fuel pump only during set time at power-on of said microprocessor;

first fuel injection control means for causing said injector to perform first fuel injection when it is confirmed that the driving of the fuel pump by said first fuel pump driving means is completed and that a start command for commanding the start of said engine is given; and starter motor driving means for driving said starter motor so as to start said engine when it is confirmed that said first fuel injection is completed and that said start command is given.

3. An engine control device that controls a fuel injection device including an injector that injects fuel to be supplied to an engine and a fuel pump that supplies the fuel to said injector, and a starter generator that functions as a starter motor at the start of said engine, and functions as a generator for charging a battery after the completion of the start of said engine, using a microprocessor that receives a power supply voltage from said battery, comprising:

first fuel pump driving means for driving said fuel pump only during set time at power-on of said microprocessor;

first fuel injection control means for causing said injector to perform first fuel injection when it is confirmed that the driving of the fuel pump by said first fuel pump driving means is completed and that a start command for commanding the start of said engine is given;

starter control means for controlling said starter generator so as to cause said starter generator to function as the starter motor to start said engine when it is confirmed that said first fuel injection is completed and that said start command is given; and generation output control means for controlling a generation output of said starter generator so as to prevent a voltage across said battery from exceeding a set value when the start of said engine is confirmed.

4. An engine control device that controls a fuel injection device including an injector that injects fuel to be supplied to an engine and a fuel pump that supplies the fuel to said injector, and a starter generator that functions as a starter motor at the start of said engine, and functions as a generator for charging a battery after the completion of the start of said engine, using a microprocessor that receives a power supply voltage from said battery, comprising:

first fuel pump driving means for driving said fuel pump only during set time at power-on of said microprocessor;

first fuel injection control means for causing said injector to perform first fuel injection when it is confirmed that the driving of the fuel pump by said first fuel pump driving means is completed and that a start command for commanding the start of said engine is given;

starter control means for controlling said starter generator so as to cause said starter generator to function as the starter motor to start said engine when it is confirmed that said first fuel injection is completed and that said start command is given; and generation output control means for controlling a generation output of said starter generator so as to prevent a voltage across said battery from exceeding a set value when the start of said engine is confirmed;

normal fuel pump control means for restarting the driving of said fuel pump after a start operation of said engine is started to control an operation of the fuel pump during the operation of the engine; and normal fuel injection control means for controlling a fuel injection amount from said fuel injection device after the start of said engine, wherein two microprocessors are provided, and said first fuel pump driving means, said first fuel pump injection control means, said normal fuel pump control means, and said normal fuel injection control means are constructed by one of said two microprocessors, and said starter control means and said generation output control means are constructed by the other of said two microprocessors.

* * * * *